US009858804B2

(12) United States Patent
Liu et al.

(10) Patent No.: US 9,858,804 B2
(45) Date of Patent: Jan. 2, 2018

(54) REMOTE CONTROLLER, REMOTE DEVICE, MULTIMEDIA SYSTEM AND THE CONTROLLING METHOD THEREOF

(71) Applicant: Sony Corporation, Minato-ku (JP)

(72) Inventors: Yinghuan Liu, Shanghai (CN); Tao Huang, Shanghai (CN)

(73) Assignee: SONY CORPORATION, Tokyo (JP)

( * ) Notice: Subject to any disclaimer, the term of this patent is extended or adjusted under 35 U.S.C. 154(b) by 577 days.

(21) Appl. No.: 13/963,270

(22) Filed: Aug. 9, 2013

(65) Prior Publication Data

US 2014/0062676 A1 Mar. 6, 2014

(30) Foreign Application Priority Data

Aug. 30, 2012 (CN) ..... 2012 1 0316577

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/50* (2013.01)

(58) Field of Classification Search
CPC .... G08C 17/02; G08C 23/04; G08C 2201/50; G07C 9/00182; G06F 3/0346
USPC ..... 340/12.22, 12.5; 345/158, 629; 463/42; 715/740
See application file for complete search history.

(56) References Cited

U.S. PATENT DOCUMENTS

| | | | | |
|---|---|---|---|---|
| 8,194,038 | B1 * | 6/2012 | Henty | G08C 23/04 178/19.05 |
| 8,990,702 | B2 * | 3/2015 | Navarro et al. | 715/740 |
| 9,022,870 | B2 * | 5/2015 | Jeffery et al. | 463/42 |
| 2009/0167555 | A1 * | 7/2009 | Kohanek | G08C 17/02 340/3.1 |
| 2009/0295719 | A1 * | 12/2009 | Choi | 345/158 |
| 2010/0007518 | A1 * | 1/2010 | Kang et al. | 340/825.72 |
| 2010/0123613 | A1 * | 5/2010 | Kohanek | G08C 19/28 341/176 |
| 2011/0018804 | A1 * | 1/2011 | Homma et al. | 345/158 |

(Continued)

*Primary Examiner* — Edwin Holloway, III
(74) *Attorney, Agent, or Firm* — Oblon, McClelland, Maier & Neustadt, L.L.P.

(57) ABSTRACT

Disclosed is a handheld device capable of being used as a remote controller, a remote device, a multimedia system and a corresponding controlling method. The handheld device being used as a remote control device for remotely controlling the remote device comprises: a communication unit, for establishing connection with a remote device and performing communication; an operation unit, for operating a specific procedure in the remote device by a user operation; a mode change unit, for switching the operation mode of the handheld device according to feedback information related to the specific procedure which is fed back by the remote device in response to the operation in the operation unit; a sensor data obtaining unit, for obtaining a sensor data, the sensor data being associated with the user hand's action in association with specific coordinate axes; and a sensor data transmission unit, for transmitting the obtained sensor data to the remote device through the communication unit. With the handheld device and remote device in the present invention, a more nature and comfortable remote operation experience can be provided for the user.

20 Claims, 7 Drawing Sheets

20

10

(56) References Cited

U.S. PATENT DOCUMENTS

| | | | | |
|---|---|---|---|---|
| 2012/0144416 | A1* | 6/2012 | Wetzer | H04N 21/25816 725/14 |
| 2012/0212505 | A1* | 8/2012 | Burroughs et al. | 345/629 |
| 2012/0326851 | A1* | 12/2012 | Xu | 340/12.26 |
| 2013/0154811 | A1* | 6/2013 | Ferren et al. | 340/12.5 |
| 2013/0247117 | A1* | 9/2013 | Yamada et al. | 725/93 |

* cited by examiner

REMOTE CONTROLLER, REMOTE DEVICE, MULTIMEDIA SYSTEM AND THE CONTROLLING METHOD THEREOF

TECHNICAL FIELDS

The present invention generally relates to a remote controller, a remote device controlled by the remote controller, a multimedia system including the remote controller and the remote device and the remote controlling method thereof. In particular, it relates to a remote controller using a smart handheld device, a remote device controlled by the smart handheld device, a multimedia system including the remote controller and the remote device and the corresponding remote control method.

BACKGROUND

In recent years, portable devices such as mobile phone, personal digital assistant, tablet personal computer etc. have been widely used in everyday life. Also, the functions of the portable devices have been extending continuously. Taking the mobile phone as an example, with the rise of the smart mobile phone, a variety of roles such as game center, media center, office assistant and so on can be achieved by installing a variety of software therein.

On the other hand, functions of the remote device such as a Television set (TV) have been extended as well to the extent that in addition to viewing traditional TV programs, it may be used for browsing web pages, watching video DVD or be used as a game display unit etc. As a result, the traditional remote controlling method in a button-press manner cannot satisfy such needs and poses difficulties for those who are not familiar with the operations of the remote controllers.

There have been proposed techniques in which a mobile phone also serves as a TC remote controller, for example, technologies in patent application publications CN201789547U and US2010/02820441A1. The technology disclosed in CN201789547U requires a specific set of hardware platform to support the remote controlling function. US2010/028044A1 discloses a technology that a mobile phone is connected to a TV via wireless communication and remotely controls the TV to perform music performance.

SUMMARY

The present invention aims to provide a more natural and comfortable experience for the user with respect to the employ of a mobile device such as a mobile phone in remote controlling a remote device such as a TV.

The Chinese patent application No. CN201110170944.x of the same applicant of the present invention is incorporated herein by reference.

According to an aspect of the present invention, a remote device having a display unit is provided, the remote device is remotely controlled by a handheld device and comprises: a communication unit, configured to establish connection with the handheld device and perform communication with the handheld device; a feedback unit, configured to, according to the operation of the handheld device with respect to a specific procedure in the remote device, feedback to the handheld device feedback information related to the specific procedure; a sensor data reception unit, configured to receive sensor data transmitted from the handheld device through the communication unit, the sensor data being associated with an action of a user's hand on specific coordinate axes;

a sensor data conversion unit, configured to convert the sensor data into standard I/O (input/output) action data; an I/O control unit, configured to perform control over an I/O unit based on the standard I/O action data; and an I/O unit, configured to perform I/O operation based on the control of the I/O control unit.

According to another aspect of the present invention, a handheld device used as a remote control device for remotely controlling a remote device is provided, the handheld device comprises: a communication unit, configured to establish connection with the remote device and perform communication; an operation unit, configured to operate a specific procedure in the remote device by a user operation; a mode change unit, configured to switch the operation mode in the handheld device according to feedback information related to the specific procedure fed back by the remote device in response to the operation in the operation unit; a sensor data obtaining unit, configured to obtain sensor data, the sensor data being associated with an action of the user's hand on specific coordinate axes; and a sensor data transmission unit, configured to transmit the obtained sensor data to the remote device through the communication unit.

According to a further aspect of the present invention, a multimedia system comprises a handheld device and a remote device being remotely controlled by the handheld device. The remote device may comprise: a communication unit, configured to establish connection with the handheld device and perform communication; a feedback unit, configured to feedback to the handheld device feedback information related to a specific procedure according to the operation of the handheld device to the specific procedure in the remote device; a sensor data reception unit, configured to receive sensor data transmitted from the handheld device through the communication unit, and the sensor data are associated with an action of a user's hand on specific coordinate axes; a sensor data conversion unit, configured to convert the sensor data into standard I/O action data of a user; an I/O control unit, configured to perform control over an I/O unit based on the standard I/O action data; and an I/O unit, configured to perform I/O operation based on the control of the I/O control unit. The handheld device comprises: a communication unit, configured to establish connection with the remote device and perform communication an operation unit, configured to operate a specific procedure in the handheld device by a user operation; a mode change unit, configured to switch the operation mode of the handheld device according to feedback information related to the specific procedure fed back by the remote device in response to the operation in the operation unit; a sensor data obtaining unit, configured to obtain sensor data, which are associated with an action of the user's hand on specific coordinate axes and representing linear or angular acceleration in association with the specific coordinate axes; and a sensor data transmission unit, configured to transmit the obtained sensor data to the remote device through the communication unit.

According to a further aspect of the present invention, it is provided a remote control method for a handheld device to remotely control a remote device, the method comprises: establishing connection with the remote device; obtaining sensor data, which are associated with an action of a user's hand on specific coordinate axes; and transmitting the obtained sensor data to the remote device through HTTP communication.

According to a further aspect of the present invention, it is provided a controlling method in a remote device, the controlling method may comprise: receiving sensor data transmitted from a handheld device, and the sensor data are associated with an action of a user's hand on specific coordinate axes; converting the sensor data into standard I/O action data of the user; performing control over the I/O unit based on the standard I/O action data; and performing I/O operation based on the I/O unit.

According to a further aspect of the present invention, it is provided a remote controlling method using a handheld device to remotely control a remote device, the method comprises: obtaining sensor data, which are associated with an action of a user's hand on specific coordinate axes and representing linear or angular acceleration in association with the specific coordinate axes; establishing connection with the remote device; transmitting the obtained sensor data to the remote device through the communication unit; receiving the sensor data transmitted from the handheld device; converting the sensor data into a standard I/O action data of the user; performing control over the I/O unit based on the standard I/O action data; performing I/O operation in the remote device based on the control of the I/O control unit.

The handheld device is used as a remote controller, the remote device and the multimedia system according to the embodiments of the present invention can bring a more natural and comfortable remote control experience to the user.

DETAILED DESCRIPTION OF THE PREFERRED EMBODIMENTS

The present invention will be more thoroughly understood by those skilled in the art by the following descriptions with reference to the drawings and embodiments.

1. Brief Overview of the Multimedia System

Figure 1:
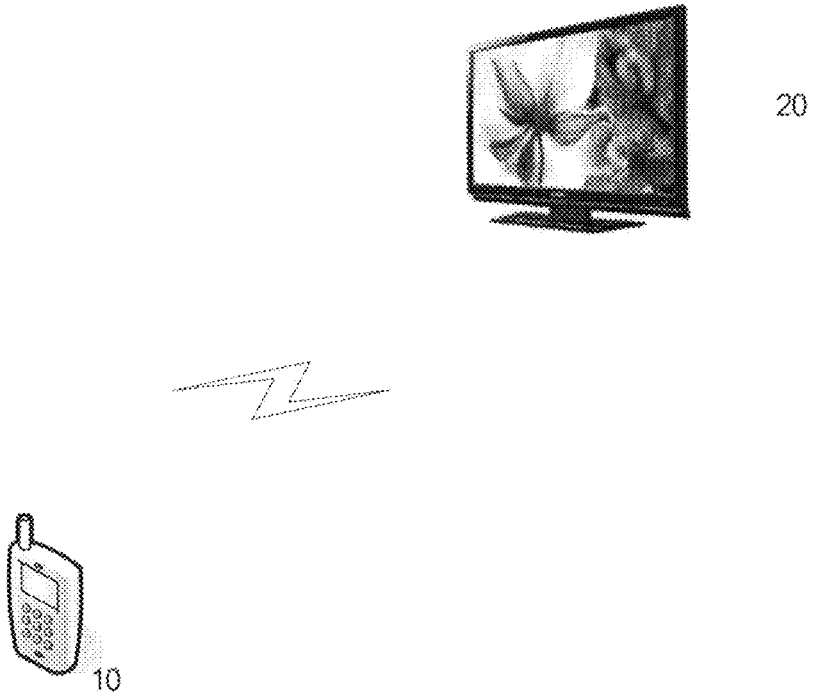
FIG. 1 shows a schematic diagram of an example of a multimedia system in which the present invention can be applied according to an embodiment of the present invention.

FIG. 1 shows a schematic diagram of an example of a multimedia system in which the present invention can be applied according to an embodiment of the present invention. As shown in FIG. 1, the multimedia system comprises a handheld device 10 and a remote device 20. In the example, a mobile phone is used as the handheld device 10 and a TV is used as the remote device 20. However, this is an example only, portable devices such as a PDA and a tablet may also be used as the handheld device 10, and a game machine, a desktop computer, a projector and the like may also be used as the remote device 20.

Please be noted that here, the operating platform run on the mobile phone may be IOS, such as that of the Iphone manufactured by the Apple Company, or Android as being used in most of the smart handheld devices, and the operating platform may also be other platforms such as Windows etc.

Preferably, for example, a connection is established between the mobile phone 10 and the TV 20 based on HTTP Protocol with Websocket. Websocket is a communication approach based on HTTP, which ensures the connection being maintained between the two communicating parties even in the case of HTTP communication, and thus guarantees the real-time of communication. As an example, one way of implementing this is that, the mobile phone user starts a browser application in the phone by clicking a corresponding icon on the touch screen of the phone, then inputs or selects a web address (URL) of the TV 20 serving as a Web server in the browser, and then a connection is established with the TV 20. Alternatively, as is described in an Chinese application No. CN201110170944.x of the same applicant of the present invention, which is incorporated therein by reference, a connection between the mobile phone 10 and the TV 20 may also be established by the mobile phone 10 reading a two-dimensional code on the housing, for example, of the TV 20.

After a connection has been established, the user may operate the mobile phone 10 to control the remote device to start a specific application program, and then perform controlling over the TV 20 by interactions between the mobile phone 10 and the TV 20.

For example, in the case of browsing a webpage with the TV, according to an embodiment of the present invention, the mobile phone 10 can be used to remotely control the TV 20 in the following manner. The mobile phone according to the present invention may capture and track the action of a user's hand. Assuming that the user swings the phone upwards, accordingly the cursor is moved upwards by a corresponding distance on the TV (across the TV screen), and if the amplitude of the upward swing is big, then the cursor on the TV moves upwards a long distance, otherwise the cursor on the TV moves upwards a small distance. Assuming that the user's wrist turns from left to right in an arc trace, accordingly the cursor on the TV follows in real time and moves in an arc trace too. Through capturing of sensor data in the mobile phone 10 which will be described in details later, angular variations in both the up-and-down and left-and-right directions of the user's hand may be achieved, which in turn allows simulation of the continuous actions of the user handheld device on the TV screen. For better understanding, more vividly, the mobile phone 10 controlling the movement of the cursor on the TV 20 is similar to a situation where the user points a laser pointer to the TV screen and when his or her wrist makes an action, the red light spot formed by the red beam of the laser pointer also moves with that action of the user. One may see that the remote control of the mobile phone serving as a remote controller of the present invention may achieve movement control of the location of a cursor on a screen as a laser pointer does, and can also provide the user an operation experience in any directions, and can achieve such control effect in any directions even when a user is not facing the screen.

A further example is when the TV 20 is used as the display unit of the game device, assuming a dancing scene is selected by a user and is being played back, the user imitates in real time and then be scored by his or her level of imitation. Here, the amplitude and direction of the movement of the user's hand may be calculated according to the action of the user's holding the mobile phone and thus a score is provided.

2. The Handheld Device Used as the Remote Controller

Figure 2:
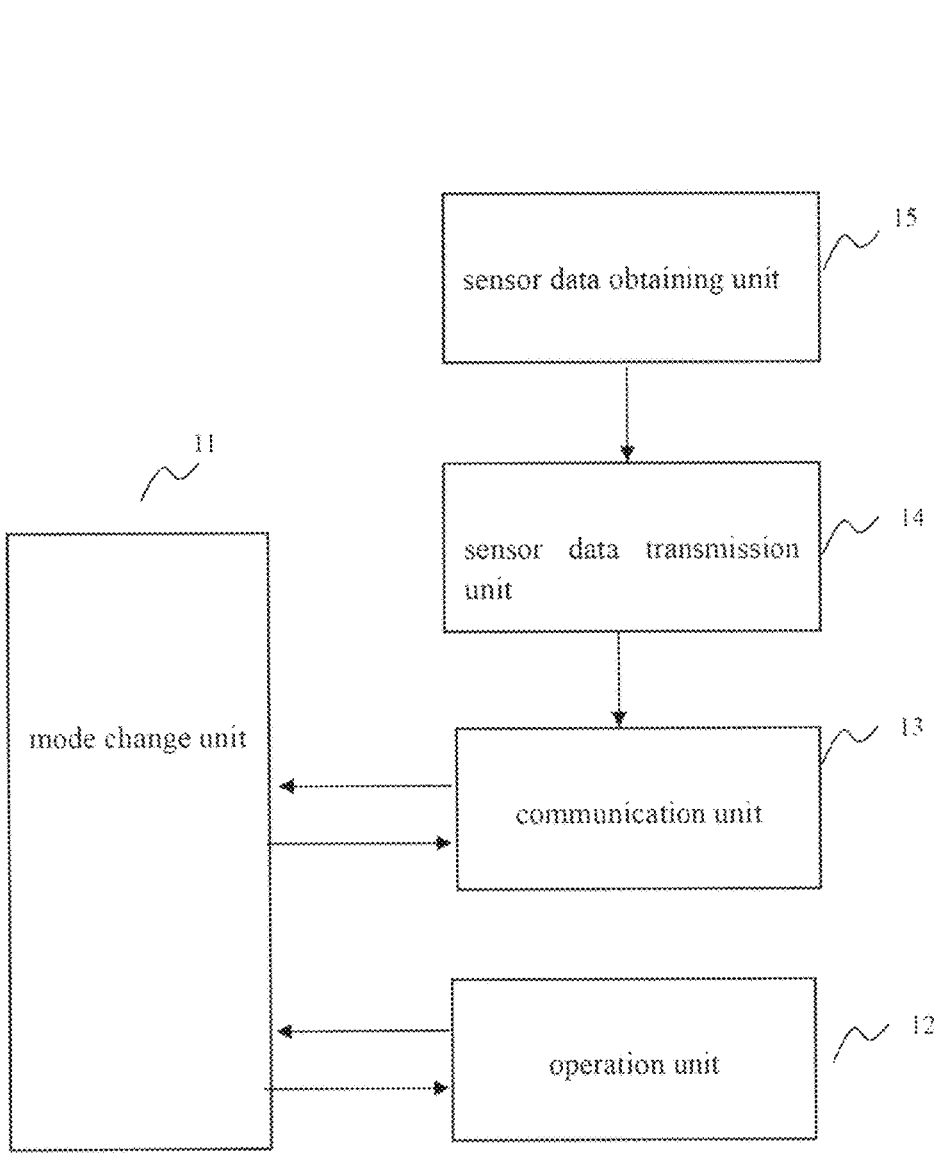
FIG. 2 shows a functional block diagram of a handheld device used as a remote controller according to an embodiment of the present invention.

Now a description of the functional configuration of the handheld device 10 being used as the remote controller according to an embodiment of the present invention will be given with reference to FIG. 2. FIG. 2 shows a functional block diagram of a handheld device used as a remote controller according to an embodiment of the present invention;

As shown in FIG. 2, the handheld device 10 may comprise: mode change unit 11, operating unit 12, communication unit 13, sensor data obtaining unit 14 and sensor data transmission unit 15.

The operating unit 12 is used as a user interface for the user to input operating commands, wherein the user interface may be e.g. a keyboard, a stylus, a touch screen and even a possible voice recognition interface etc. Furthermore, in a situation that the mobile phone is used as a remote controller, the user may operate the operating unit 12 in order to operate a specific procedure (or program) in the remote device.

The communication unit 13 is used to establish connection with the remote device 20 and perform communications. The manner of communication is not particularly limited and may be in various ways such as wired network, Wifi, Bluetooth, and infrared rays etc. Preferably, the communication unit 13 communicates with the remote device based on HTTP protocol. More preferably, the communication unit 13 communicates with the remote device based on Websocket.

The mode change unit 11 switches an operation mode in the handheld device according to the feedback information related to the specific procedure which is fed back by the remote device in response to the operation in the operation unit, in other words, changes the operation mode of the remote controller 1, based on the information obtained from the remote device 20 through the communication between the communication unit 13 and the remote device 20, e.g. from the phone mode to the remote controller mode, or to a mode where the phone mode and the remote controller mode co-exist.

The function, configuration and operating method of the mode change unit 11, operating unit 12 and communication unit 13 have been thoroughly described in the application No. CN201110170944.x of the same applicant of the present invention, which is incorporated here, therefore the description thereof will be omitted here.

The sensor data obtaining unit 14 and sensor data transmission unit 15 of the handheld device 10 are now described in details.

The sensor data obtaining unit is used to obtain sensor data, which are associated with the action of the user's hand in association with specific coordinate axes and represent a linear or angular acceleration in the directions of the specific coordinate axes.

The sensor may be in the forms of a gyroscope (gyro), a gravity sensor (G-sensor) or an electronic compass sensor etc.

For example, a gyro is installed in a handheld device (such as a mobile phone) with a platform version IOS 4.2 or above of Apple Company, a three-axis liner acceleration can be obtained. The three axes refer to Roll (left-and-right tilting), Pitch (forward-and-backward tilting) and Yaw (swinging left and right) and are considered as three types of essential data of the gyro with which the angular variation of the handheld device is sensed and then the location of the user can be tracked through computation. In addition, as for handheld device with a version iOS 4.2 or above platform, directly obtaining the three-axis sensor data from the built in browser application such as Safari of Apple Company is supported. In this example, the reception of the three-axis angular variation by the browser is of event-trigger mechanism, that is, only when bottom layer sensor data have been changed, the browser would receive and handle the corresponding event. In this case, an API (Application Program Interface) has been provided by the browser for the direct reading of the three-axis sensor data, in particular, e.g. the three-axis angular variation value.

In this case, the sensor data obtaining unit 14 according to the embodiment of the present invention may make use of the existing API provided by the browser to read the three-axis sensor data directly from the browser of the handheld device.

In this point of view, the sensor data transmission unit 15 may transmit the three-axis sensor data obtained by the sensor data obtaining unit 14 to the remote device 20 through a Web page program.

In some cases however, even though a gyro is installed in a smart handheld device, it happens that the browser of that device does not provide Web API for the direct reading of the sensor data from the browser. For example, some smart handheld devices with Android platform might have gyros installed therein, but do not support the direct reading of sensor data from the browser. In this case, the sensor data obtaining unit 14 according to the embodiment of the present invention may use a sensor data obtaining interface provided by that smart handheld device to obtain the sensor data.

After that, the sensor data transmission unit 15 may convert such sensor data into Web data, and then transmit the converted sensor data to the remote device 20 through a Web page program.

In some other cases, it is possible that the smart handheld device is not provided with a gyro, but is provided with a G-sensor and an electronic compass sensor. As is well known that the G-sensor is realized with piezoelectric effect, it determines a horizontal direction by measuring the component of the gravity in two orthogonal directions of an inner object with some weight. The G-sensor may be considered as a type of two-axis acceleration meter. Electronic compasses can be categorized into two types i.e. plane electronic compass and three dimensional electronic compass and have the ability of detecting the Pitch and Roll etc. In this case, the sensor data obtaining unit 14 according to the embodiment of the present invention may calculate the required sensor data such as three-axis angular variation based on the data sensed by the G-sensor and the electronic compass sensor.

Then, in a similar manner, the sensor data transmission unit 15 may convert such sensor data into Web data, and then transmit the sensor data to the remote device 20 through a Web page program.

The transmission of the sensor data from the sensor data transmission unit 15 to the remote device 20 through a Web page program as described above may be realized by Websocket, which is described in details in the Chinese application No. CN201110170944.x with the same applicant of the present invention that is incorporated into the present invention.

It is described above by taking the gyro, G-sensor and electronic compass as examples of sensors for detecting location and orientation, but the present invention is not limited to these exemplary sensors and any two-axis or three-axis accelerator meter can be used for the present invention as long as the location and orientation such as an absolute angle or relative angle variation of the handheld device can be obtained from such sensors.

The remote control over the remote device 20 by the handheld device 10 of the present invention, through the reception and transmission operation of the sensor data and in conjunction with the conversion process and input/output response to the received sensor data by the remote device 20 to be described in the following part, can provide the user with operation experience in any directions.

3. Remote Device

Figure 3:
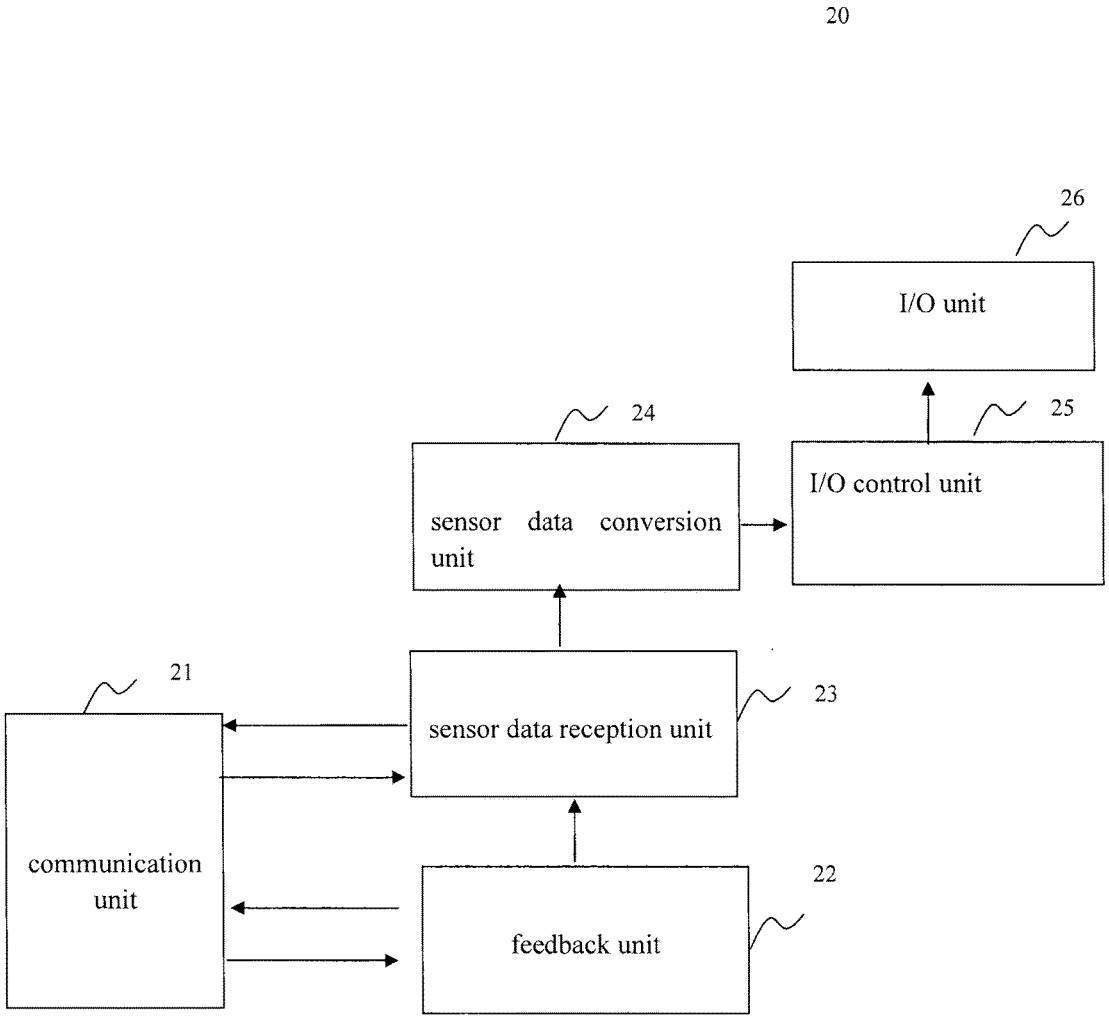
FIG. 3 shows a functional block diagram of a remote device according to an embodiment of the present invention.

The functional configuration of the remote device 20 according to an embodiment of the present invention will now be described with reference to FIG. 3. FIG. 3 shows a functional configuration block diagram of a remote device 20 according to an embodiment of the present invention.

As shown in FIG. 3, the remote device 20 comprises: a communication unit 21, a feedback unit 22, a sensor data reception unit 23, a sensor data conversion unit 24, an I/O (input/output) control unit 25 and an I/O unit 26.

The communication unit 21 is used to establish connection with the remote control device (the handheld device in this case) and perform communication. The manner of communication is not particularly limited and may be in various ways such as cable network, Wifi, Bluetooth, and infrared rays etc. Preferably the remote device 20 is provided with a WebSocket server application therein. A user can operate a browser provided in the remote controller 1, so as to establish a WebSocket connection with the remote device 20.

The feedback unit 22, according to operations performed by the remote control device to a specific procedure in the remote device, feedbacks the feedback information related to the specific procedure to the remote control device.

The function, configuration and operating method of the communication unit 21 and feedback unit 22 have been thoroughly described in the Chinese application No. CN201110170944.x which is incorporated here, so the description thereof will be omitted here.

Now the sensor data reception unit 23, sensor data conversion unit 24, I/O control unit 25 and I/O unit 26 in the remote device 20 will be described in details.

The sensor data reception unit 23 is used for receiving sensor data transmitted from the handheld device through the communication unit 21. The sensor data are associated with the action of a user's hand in association with specific coordinate axes. The actions may be ROLL (left-and-right tilting), Pitch (forward-and-backward tilting), Yaw (swinging left and right) or any combinations of these actions.

The sensor data conversion unit 24 converts the sensor data into standard I/O action data, such as into mouse and/or keyboard action. At this point, the conversion operation is a simulation of the user controlling a TV with a mouse and/or a keyboard.

The I/O control unit 25 performs controlling over the I/O unit based on the standard I/O action data.

The I/O unit 26 performs input and output based on the control of the I/O control unit. It preferably controls the game run on the TV, and performs movement of the cursor on the TV display screen, corresponding sound response and even switching of the displayed pictures.

4. Examples of the Remote Controlling Method Performed in the Handheld Device

Figure 4:
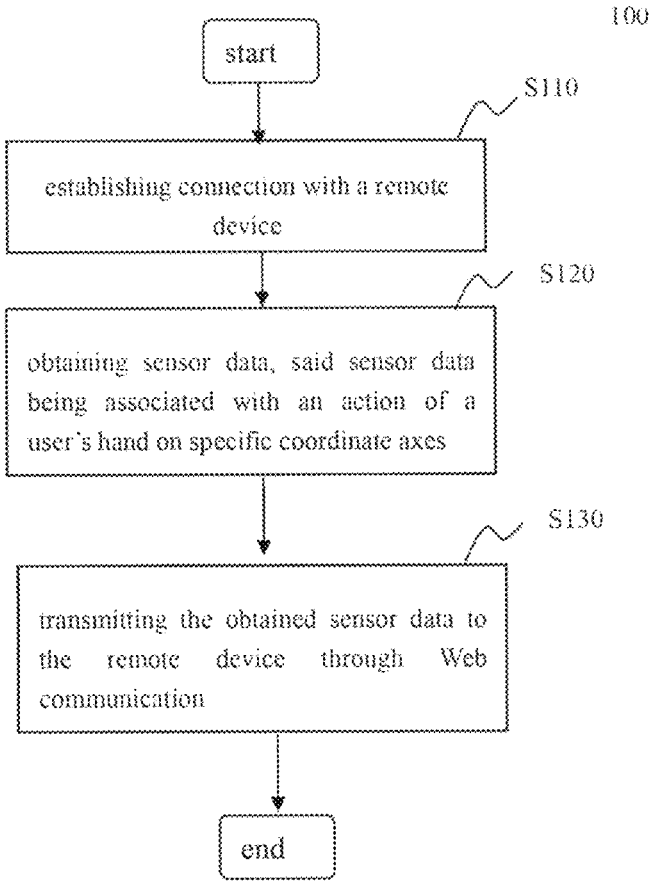
FIG. 4 shows a flow chart of an exemplary remote controlling method performed in the handheld device according to an embodiment of the present invention.

FIG. 4 shows a flow chart of an exemplary remote controlling method performed in the handheld device according to an embodiment of the present invention.

As shown in FIG. 4, in step S110, a connection is established with the remote device and communication is performed. As is described above, the manner of communication is not particularly limited and may be in various ways such as cable network, Wifi, Bluetooth, and infrared rays etc. Preferably, the handheld device communicates with the remote device based on Websocket.

In step S120, the sensor data are obtained, which are associated with the action of the hand of a user in association with specific coordinate axes.

As described above, when the handheld device is provided with a three-axis acceleration sensor such as a gyro and supports the direct reading of sensor data from a built-in browser, the sensor data may be directly read from the browser and then transmitted to the remote device side in a manner such as WebSocket.

When the handheld device is provided with a three-axis acceleration sensor such as a gyro, but does not support direct reading of sensor data from the browser, the captured sensor data may be firstly converted into the form of WebAPI, then the browser is informed of the data change, and the sensor data are transmitted to the side of the remote device in a manner such as WebSocket.

When the handheld device is not provided with any three-axis acceleration sensor such as a gyro, but is provided with a G-sensor and an electronic compass, the data of the G-sensor and the electronic compass may be captured, and required sensor data such as three-axis angular variation can be calculated based on the captured data, and the captured data will be converted into the form of WebAPI, then the browser is informed of the data change and the sensor data are transmitted to the side of the remote device in a manner such as WebSocket.

In step S130, the obtained sensor data are transmitted to the remote device through HTTP communication.

As is described above, preferably, the sensor data are transmitted to the side of the remote device in the manner of WebSocket.

In addition, noise-reduction processing etc. may be performed before the transmission of the sensor data to the remote device.

5. Examples of the Controlling Method Performed in the Remote Device

Figure 5:
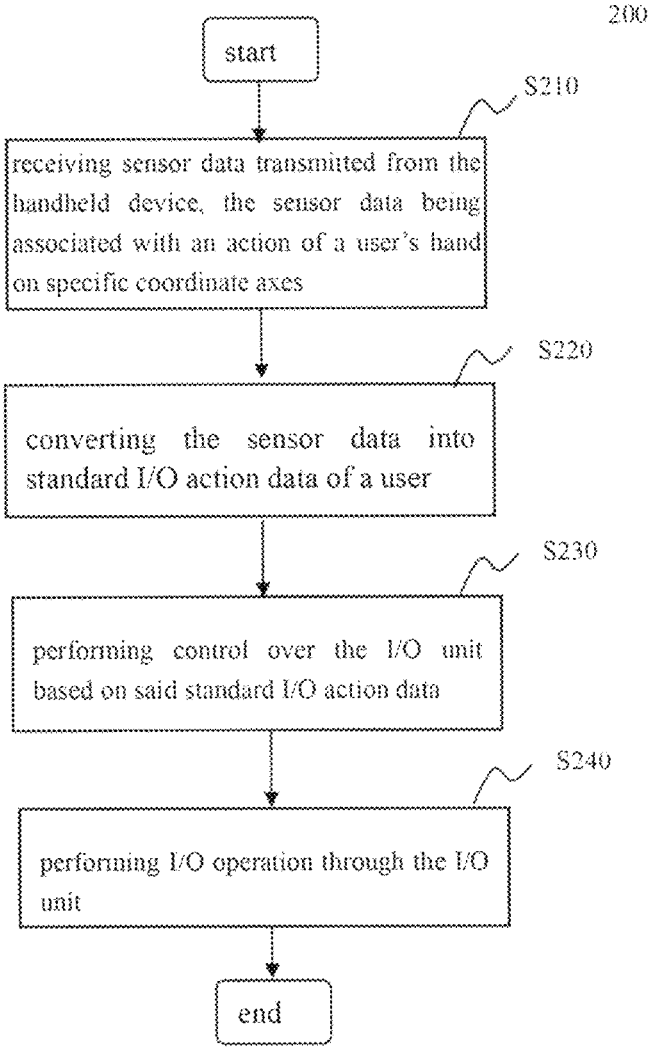
FIG. 5 shows a flow chart of a controlling method performed in the remote device according to an embodiment of the present invention.

FIG. 5 shows a flow chart of controlling method performed in the remote device according to an embodiment of the present invention;

As shown in FIG. 5, at step S210, the sensor data transmitted from the handheld device is received; and the sensor data are associated with the action of the user's hand on the specific coordinate axes.

In step S220, the sensor data are converted into standard I/O action data of the user, e.g. into mouse and/or keyboard action. Here, the conversion operation is considered as a simulation of the user's controlling the TV with a mouse and/or a keyboard.

In step S230, a control is performed on the I/O unit based on the standard I/O action data.

In step S240, input and output is performed through the I/O unit. For example, movement of the cursor on the TV display screen, corresponding sound response and even switching of the display pictures are performed.

6. Sensor Data Processing Method

Preferably, during the conversion of sensor data, for the purpose of better simulating the I/O action of a user and bringing a more natural and comfortable operating experience, some optimizing process may be performed preferably. Some examples of these optimizing process methods will now be described in details.

Now browsing a webpage on a TV screen will be taken as an example for illustrating the sensor data processing method.

6.1 Non-Linear Conversion Method of the Displacement

When browsing a webpage on the TV screen, a user uses a handheld device to control the pointer of a cursor on the TV, and the conversion between a wrist twisting angle and the corresponding cursor displacement is generally linear and proportional. Generally, the maximum range of movement of a wrist from left to right and from up to down is about 60 degrees. Assuming that in general the wrist twisting angle is denoted by X, the corresponding cursor displacement is denoted by Y, and the proportional coefficient of the equally proportional and linear conversion is set to be $C_1$, so the relationship between the wrist twisting angle X and cursor displacement Y is expressed in the following equation (1):

$$Y=C_1X \tag{1}$$

However, when the user moves within a small range, he or she may wish to have an accurate control over the cursor and does not want the magnitude of the cursor displacement to be too big. Assuming the proportional coefficient of the equally proportional and linear conversion would be $C_2$ in order to meet the need of accurate control, so the relationship between the wrist twisting angle X and cursor displacement Y when movement is made in small range can be expressed in equation (2):

$$Y=C_2X \tag{2}$$

Figure 6:
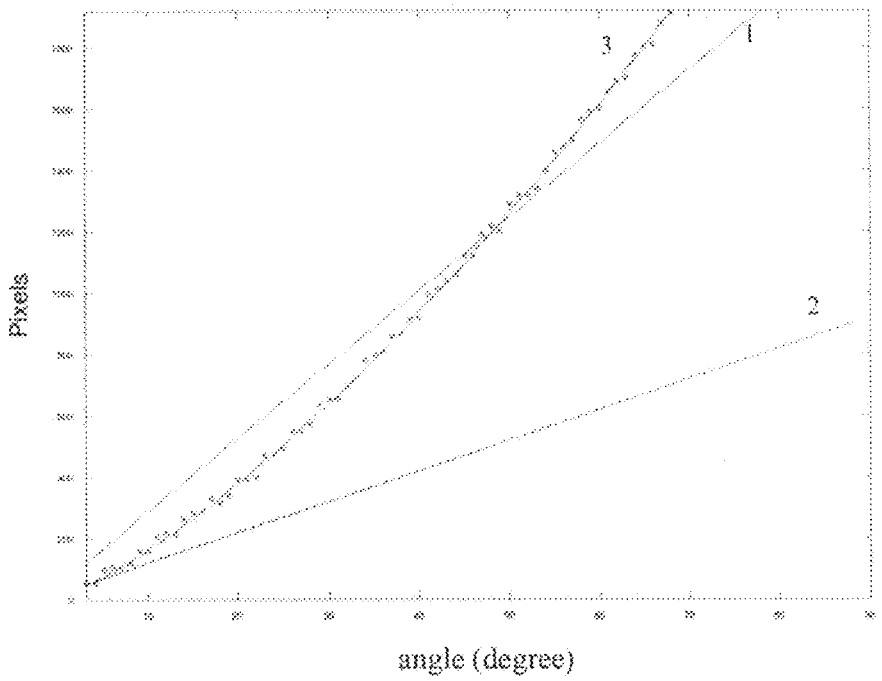
FIG. 6 schematically shows the relationship between the angular variation of a wrist and cursor displacement on TV in general.

In practice, an existing problem is that, in most cases, $C_1>C_2$, i.e. as the relationship between a Line 1 and a Line 2 shown in FIG. 6, in which the slope of Line 1 is $C_1$ and the slope of Line 2 is $C_2$. In other words, the current equally proportional and linear conversion method can not meet the needs of a user to have accurate control within a small range. Although, if the ratio coefficient $C_2$ has been adopted to satisfy the requirements of accurate control within a small range, then it might result in an overly small displacement range, thus the user's requirements to make rapid displacement within a big range can not be satisfied.

In brief, the prior art fails to satisfy the user's following requirements at the same time: an accurate control when the range of movement is small and rapid displacement when the range of movement is big.

For this reason, the inventor has come up with the idea of replacing the linear conversion function with a non-linear conversion function for converting the wrist angular variation to cursor displacement so that the ratio between the cursor displacement and angular variation when the angular variation is big is greater than the ratio between the cursor displacement and angular variation when the angular variation is small. For example, the relationship of the wrist angular variation and the cursor displacement may be in the form of Curve 3 as shown in FIG. 6. In FIG. 6, the horizontal axis represents the wrist angular variation of the user using the handheld device and the y-axis represents the cursor displacement on the TV screen.

Assuming that the conversion curve of angle to pixels that we wish to have is:

$$Y=\varphi(X) \tag{3}$$

Assuming the angle is within the range of $X\epsilon(X_{min},X_{max})$, within this range the slope $C_n$ of any point $X_n$ (i.e. here the ration of angle-to-pixel $Y=C_nX_n$) is the derivative of $\varphi(X)$.

$$C_n=\varphi(X_n) \tag{4}$$

The range of value of $C_n$ has to be within the range of $C_n\epsilon(C_1,C_2)$ to satisfy the user's requirements.

Accordingly the following equation set made of equation (4) and equation (5) are obtained as $$C_1=\varphi(X_{min}) \tag{4}$$

$$C_2=\varphi(X_{max}) \tag{5}$$

Therefore, given the non-linear function form between the angular variation X and the cursor displacement Y, the conversion equation $Y=\varphi(X)$ can be obtained by way of solving the equations.

For example, if the non-linear function form between the angular variation X and the cursor displacement Y is in the form of power function, e.g. the nth power of X, i.e. $\varphi(X)=C_2X^n$, then $$\varphi(X)=nC_2X^{n-1}$$

According to equations (4), (5), the following can be obtained as $$C_1=nC_2(X_{min})^{n-1} \tag{6}$$

$$C_2=nC_2(X_{max})^{n-1} \tag{7}$$

By dividing equation (6) by equation (7), equation (8) is obtained as $$\frac{C_1}{C_2}=\left(\frac{X_{min}}{X_{max}}\right)^{n-1} \tag{8}$$

Taking a logarithm(base e) of both sides of the equation and equation (9) is obtained as $$\ln\left(\frac{C_1}{C_2}\right)-(n-1)\ln\left(\frac{X_{min}}{X_{max}}\right) \tag{9}$$

Which can also be expressed as equation (10)

$$\ln(C_1)-\ln(C_2)=(n-1)(\ln(X_{min})-\ln(X_{max})) \tag{10}$$

After transforming equation (10), n in the form of equation (11) is obtained as $$n=\frac{\ln(C_1)-\ln(C_2)}{\ln(X_{min})-\ln(X_{max})}+1 \tag{11}$$

Substituting equation (11) back into equation (6) may obtain coefficient $C_3$, expressed in equation (12) as $$C_1=\frac{nC_1}{(X_{min})^{n-1}} \tag{12}$$

The example takes power function as the form of the non-liner function. However, this is only given as an example and the present invention is not limited thereto and may take the forms of logarithm or exponent as long as it is satisfied that, within the range of wrist twisting (e.g. 60 degrees), a non-linear curve 3 is between the line 1 and line 2, as shown in FIG. 6.

It is illustrated with the example of wrist twisting angle range as 60 degrees. However, this is a general case and the wrist twisting angle can have other ranges.

6.2 Anti Jitter Threshold Filtering Process

The gyroscope, G-sensor or electronic compass in the handheld device may be very sensitive. In use, even when the user does not want to move the cursor's pointer, it may tremble on the screen due to the shaking of the user's hand unintentionally, which will affect the user's experience.

Figure 7:
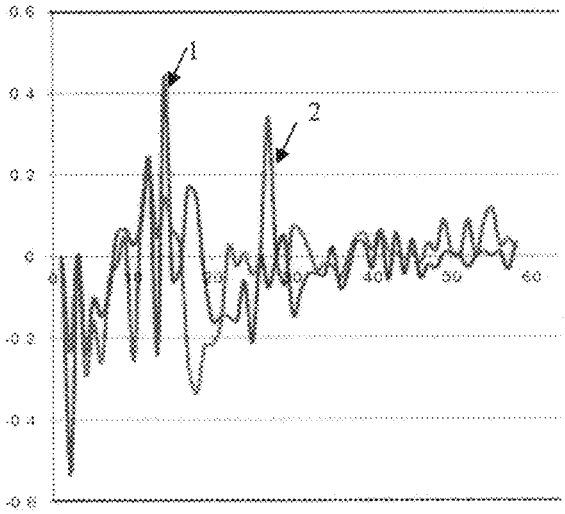
FIG. 7 schematically provides a figure of the vibration amount of a handheld device in left-and-right direction and the vibration of a handheld device in up-and-down direction with time elapses within a period of time.

FIG. 7 schematically provides the vibration of a handheld device in left-and-right direction and the vibration of a handheld device in up-and-down direction with time elapses within a period of time, wherein the horizontal axis represents time in the unit of second; the vertical axis represents angle of the remote controller that has moved in the unit of 10-degree. Curve 1 as indicated by a reference number 1 represents the vibration of the remote controller in the left-and-right direction with time elapses, Curve 2 as indicated by a reference number 2 represents the vibration of the remote controller in the up-and-down direction with time. Curve 1 and Curve 2 show that even when the users does not want to move the cursor, the magnitude of vibration of the remote controller may still be captured by the gyroscope. Especially when the user is talking (as shown in the first 30 seconds in the figure), the magnitude of vibration of the remote controller is relatively greater and the cursor pointer on the screen trembles continuously.

It is found out with considerable experiments that when the user is holding the handheld device and remains relatively static, the angular variation of the sensor keeps within a range of about [0, 6] (in the unit of degree). In order to prevent the trembling noise, according to one preferred embodiment of the present invention, during conversion of the sensor data, the cursor displacement is set to zero when the angular variation is smaller than a predetermined threshold. This threshold may be set according to experience, to e.g. 6 degrees or be obtained by learning.

The above anti-jitter filtering process according to an embodiment of the present invention may prevent trembling on the TV screen due to unintentional shaking of the user's hand and can bring the user a more comfortable operating experience.

6.3 Interpolation Smoothing Movement Process

The inventor has found out after considerable experimental observation that, the a handheld device usually generates sensor data at a frequency about 10-20 times/second (e.g. the generation frequency for an Android platform handheld device is 10 times/sec in average, and for an IOS platform device is 20 times/sec in average) while it is known that the response capability of human's eyes is about 1/24 sec. So if the cursor is moved according to the generation frequency of sensor data, then it makes the user feel that the cursor's move is unsmooth and it seems the cursor jumps around.

Therefore, according to an embodiment of the present invention, the interpolation is adopted to process the cursor displacement. For example, when the angular variation X of the sensor is received, the cursor displacement pixel value Y will be calculated according to equation (5) and then equally divided by n (e.g. for Android platform n may be set to 3, for IOS platform n may be set to 2). Accordingly, one time of cursor movement is transmitted in n times by design.

Therefore, the interpolation process to the sensor data according to any embodiment of the invention has effectively solved the problem of the unsmooth movement of the cursor and thus brings a more comfortable operating experience to the user.

In the above descriptions, the conversion of the sensor data, that is non-linear conversion of the displacement, anti-jitter threshold filtering process, interpolation smoothing movement process are described to be performed at the side of the remote device such as a TV side. However, this is only given as an example and the present invention is not limited thereto, all or part of the above conversion process of the sensor data may also be performed at the side of the handheld device such as the mobile phone side, or even be performed by a third party data processing device, that is the mobile phone transmitting the sensor data to a third party data processing device which in turn performing data processing on the sensor data and transmitting the processed sensor to a remote device such as TV.

In addition, in the above description, the angular variation of the user's hand is associated with the cursor displacement on the TV. However, this is only given as an example and the present invention is not limited thereto, the angular variation of the user's hand may be associated with other input/output data of the TV, the examples of which include: e.g. character (person) movement or visual angle turning in a game may be controlled by the angular variation of the user's hand, and variations of sound volume, magnitude or frequency of a character's action in a display picture may all be controlled by the angular variation of the user's hand.

In the above descriptions, a mobile phone is taken as an example of a handheld device used as a remote controller. However, this is only an example and the handheld device as a remote controller is not limited to the form of mobile phones and may also be a personal digital assistant, a tablet, a multimedia player (such as a MP3 player) etc.

In the above descriptions, a TV is taken as an example of a remote device as the object being remotely controlled. However, this is only an example and the remote device is not limited to the TV and may also be e.g. a desk computer, projector and so on.

In the above descriptions, the wrist twisting angle of a user is detected by a sensor and simulated as a standard I/O at the side of the remote device such as the TV side. However, using a handheld device to remotely control the remote device is not limited to using the action of the user's hand only, and may be combined with other kinds of input of the user, such as touch input to the touch screen of the handheld device, keyboard input and sound/voice input etc.

The fundamental principle of the present invention has been described in combination with the embodiment, but it shall be understood by a person skilled in the art that all or any step or part of the method and means of the present invention may be implemented in the form of a hardware, a firmware, a software or any combination thereof in any computing means (including processor, storage medium etc.) or the networks of the computing means, and an ordinary person skilled in the art would be able to achieve this with his or her basic programming skills after reading the specification of the present invention.

Therefore, the present invention may also be realized by providing a program product comprising the program code for realizing the method or means. That is to say, such program product also embodies the present invention and the storage medium storing such program product therein embodies the present invention as well. Apparently, the storage medium may be any well known storage medium or those to be developed in the future.

Furthermore, in the means and method of the present invention, each part or step may be disassembled and/or recombined. These disassembling and recombination shall be considered equivalent approach of the present invention. In addition, the steps of the above series of process may be performed by naturally following the time order as described but not necessarily have to. Some steps may be performed in parallel or separately from each other.

The above embodiment shall not be taken as limitations to the scope of the present invention. A person skilled in the art shall appreciate that various change, combination, sub-combination and substitution may occur depending on the design requirements and factors elsewhere. Any change, equivalent substitution and improvement made within the spirit and principle of the present invention shall be included in the scope of the present invention.

What is claimed is:

1. A remote device having a display, said remote device being remotely controlled by a handheld device and comprising:

circuitry configured to:

establish a connection with the handheld device and perform communication;

feedback to the handheld device feedback information related to a specific procedure according to an operation of said handheld device to said specific procedure in said remote device;

receive sensor data transmitted from the handheld device, said sensor data being associated with an action of a user's hand in association with specific coordinate axes;

convert the sensor data into standard I/O (input/output) action data including obtaining an angular variation of the handheld device in a direction based on the sensor data, and converting said angular variation into cursor displacement or other I/O data of the remote device using a non-linear function between the angular variation and the cursor displacement or other I/O data of the remote device, so that a ratio between the cursor displacement or other I/O data of the remote device and the angular variation when the angular variation is big is higher than the ratio when the angular variation is small;

perform control based on said standard I/O action data; and perform an I/O operation based on the performed control, wherein within a range of wrist twisting, the non-linear function falls between a first linear function and a second linear function, the first linear function including a coefficient C1, the second linear function including a coefficient C2 that is smaller than the coefficient C1, and the second linear function representing accurate control within a small range of the range of wrist twisting.

2. The remote device according to claim 1, wherein the circuitry is further configured to:

receive the sensor data transmitted from the handheld device through HTTP communication.

3. The remote device according to claim 1, wherein the circuitry is further configured to:

set the cursor displacement or other I/O data of the remote device to zero when the angular variation is less than a predetermined threshold.

4. The remote device according to claim 1, wherein the circuitry is further configured to:

obtain the angular variation at a predetermined frequency, calculate a corresponding cursor displacement or other I/O data of the remote device, divide the calculated cursor displacement or other I/O data of the remote device equally into n parts of cursor displacement or n parts of other I/O data, and transmit the equally divided n parts of cursor displacement or the equally divided n parts of other I/O data of the remote device to the display in n times of transmissions, where n is larger or equal to 2.

5. The remote device according to claim 1, wherein the non-linear function is in the form of a power function.

6. The remote device according to claim 1, wherein the non-linear function is in the form of a logarithmic function.

7. The remote device according to claim 1, wherein the non-linear function is in the form of an exponential function.

8. A handheld device used as a remote control device for remotely controlling a remote device, comprising:

circuitry configured to:

establish a connection with the remote device and perform communication;

operate a specific procedure in the remote device by a user operation;

switch an operation mode of the handheld device according to feedback information related to the specific procedure which is fed back by the remote device in response to an operation;

obtain sensor data, said sensor data being associated with an action of the user's hand in association with specific coordinate axes; and transmit the sensor data to the remote device, wherein the sensor data is converted into standard I/O action data including conversion of an angular variation into cursor displacement or other I/O data of the remote device using a non-linear function between the angular variation and the cursor displacement or other I/O data of the remote device, so that a ratio between the cursor displacement or other I/O data of the remote device and the angular variation when the angular variation is big is higher than the ratio when the angular variation is small, within a range of wrist twisting, the non-linear function falls between a first linear function and a second linear function, the first linear function including a coefficient C1, the second linear function including a coefficient C2 that is smaller than the coefficient C1, and the second linear function representing accurate control within a small range of the range of wrist twisting.

9. The handheld device according to claim 8, wherein the circuitry is further configured to:

establish the connection based on HTTP with the remote device.

10. The handheld device according to claim 8, wherein the circuitry is further configured to:

establish the connection based on WebSocket with the remote device.

11. The handheld device according to claim 8, wherein:

the circuitry includes a gyro device for detecting the sensor data, and the circuitry is further configured to directly read said sensor data through an interface provided by a browser.

12. The handheld device according to claim 8, wherein:

the circuitry includes a gyro device for detecting the sensor data, and the circuitry is further configured to convert the sensor data into Web data and informs a Web browser of a data change.

13. The handheld device according to claim 8, wherein:

the circuitry includes a gravity sensor and an electronic compass, and circuitry is further configured to:

calculate the sensor data based on data of the gravity sensor and the electronic compass, and convert the sensor data into Web data and informs a Web browser of a data change.

14. A multimedia system comprising a handheld device and a remote device being remotely controlled by the handheld device, wherein the remote device comprises:

circuitry configured to:

establish connection with the handheld device and perform communication;

feedback to the handheld device feedback information related to a specific procedure according to an operation of said handheld device to said specific procedure in said remote device;

receive sensor data transmitted from the handheld device, said sensor data being associated with an action of a user's hand in association with a specific coordinate axes;

convert the sensor data into standard I/O action data of a user including obtaining an angular variation of the handheld device in a direction based on the sensor data, and converting said angular variation into cursor displacement or other I/O data of the remote device using a non-linear function between the angular variation and the cursor displacement or other I/O data of the remote device, so that a ratio between the cursor displacement or other I/O data of the remote device and the angular variation when the angular variation is big is higher than the ratio when the angular variation is small, perform control based on said standard I/O action data; and perform an I/O operation based on the performed control, the handheld device comprises:

circuitry configured to:

establish a connection with the remote device and perform communication;

operate a specific procedure in the remote device by a user operation;

switch an operation mode of the handheld device according to feedback information related to the specific procedure which is fed back by the remote device in response to an operation;

obtain the sensor data; and transmit the obtained sensor data to the remote device, within a range of wrist twisting, the non-linear function falls between a first linear function and a second linear function, the first linear function including a coefficient C1, the second linear function including a coefficient C2 that is smaller than the coefficient C1, and the second linear function representing accurate control within a small range of the range of wrist twisting.

15. A remote control method for a handheld device to remotely control a remote device, the method comprising:

establishing a connection with the remote device;

obtaining sensor data, said sensor data being associated with an action of a user's hand on specific coordinate axes; and transmitting the sensor data to the remote device through HTTP communication, wherein the sensor data is converted into standard I/O action data including conversion of an angular variation into cursor displacement or other I/O data of the remote device using a non-linear function between the angular variation and the cursor displacement or other I/O data of the remote device, so that a ratio between the cursor displacement or other I/O data of the remote device and the angular variation when the angular variation is big is higher than the ratio when the angular variation is small, within a range of wrist twisting, the non-linear function falls between a first linear function and a second linear function, the first linear function including a coefficient C1, the second linear function including a coefficient C2 that is smaller than the coefficient C1, and the second linear function representing accurate control within a small range of the range of wrist twisting.

16. A controlling method in a remote device, the method comprising:

receiving sensor data transmitted from a handheld device, said sensor data being associated with an action of a user's hand in association with specific coordinate axes;

converting the sensor data into standard I/O action data of the user including obtaining an angular variation of the handheld device in a direction based on the sensor data, and converting said angular variation into cursor displacement or other I/O data of the remote device using a non-linear function between the angular variation and the cursor displacement or other I/O data of the remote device, so that a ratio between the cursor displacement or other I/O data of the remote device and the angular variation when the angular variation is big is higher than the ratio when the angular variation is small;

performing control based on said standard I/O action data; and performing an I/O operation based on the control, wherein within a range of wrist twisting, the non-linear function falls between a first linear function and a second linear function, the first linear function including a coefficient C1, the second linear function including a coefficient C2 that is smaller than the coefficient C1, and the second linear function representing accurate control within a small range of the range of wrist twisting.

17. The controlling method according to claim 16, wherein:

the sensor data transmitted from the handheld device is received through HTTP communication.

18. The controlling method according to claim 16, further comprising:

setting the cursor displacement or other I/O data of the remote device to zero when the angular variation is less than a predetermined threshold.

19. The controlling method according to claim 16, further comprising:

calculating a corresponding cursor displacement or other I/O data of the remote device, dividing the calculated cursor displacement or other I/O data of the remote device equally into n parts of cursor displacement or n parts of other I/O data, then transmitting the equally divided n parts of cursor displacement or the equally divided n parts of other I/O data of the remote device to a display in n times of transmission, where n is larger or equal to 2.

20. A remote controlling method for using a handheld device to remotely control a remote device, the method comprising:

obtaining sensor data, said sensor data being associated with an action of a user's hand in association with specific coordinate axes and representing linear or angular acceleration in association with the specific coordinate axes;

establishing a connection with the remote device;

transmitting the obtained sensor data to the remote device;

receiving the sensor data transmitted from the handheld device;

converting the sensor data into a standard I/O action data of the user including conversion of an angular variation into cursor displacement or other I/O data of the remote device using a non-linear function between the angular variation and the cursor displacement or other I/O data of the remote device, so that a ratio between the cursor displacement or other I/O data of the remote device and the angular variation when the angular variation is big is higher than the ratio when the angular variation is small;

performing control based on said standard I/O action data; and performing an I/O operation in the remote device based on the control, wherein within a range of wrist twisting, the non-linear function falls between a first linear function and a second linear function, the first linear function including a coefficient C1, the second linear function including a coefficient C2 that is smaller than the coefficient C1, and the second linear function representing accurate control within a small range of the range of wrist twisting.

* * * * *